United States Patent [19]

Spector et al.

[11] 4,227,264

[45] Oct. 14, 1980

[54] CONVERTIBLE WOMEN'S ENSEMBLE

[76] Inventors: Donald Spector; Anita Burch, both of 380 Mountain Rd., Union City, N.J. 07087

[21] Appl. No.: 61,012

[22] Filed: Jul. 26, 1979

[51] Int. Cl.[2] ..... A41D 9/00

[52] U.S. Cl. ..... 2/84; 2/97; 2/272

[58] Field of Search ..... 2/84, 97, 86, 85, 95, 2/105, 74, 77, 114, 87, 89, 213, 212, 211, 71, 72, 272, 202, 209.1

[56] References Cited

U.S. PATENT DOCUMENTS

| | | | |
|---|---|---|---|
| 1,664,309 | 3/1928 | Mueller | 2/86 |
| 2,004,985 | 6/1935 | Hogan | 2/97 |
| 2,051,437 | 8/1936 | Dorn | 2/84 |
| 3,077,605 | 2/1963 | Salvatore | 2/97 |
| 3,147,491 | 9/1964 | Fisch | 2/86 |

*Primary Examiner*—Doris L. Troutman
*Attorney, Agent, or Firm*—Michael Ebert

[57] ABSTRACT

A convertible women's ensemble capable of satisfying a range of apparel requirements, a single ensemble making it possible for the wearer to be appropriately dressed for active wear, for informal and formal occasions and for rain or shine. The ensemble is constituted by a long jacket and a pair of slacks, the jacket being preferably fabricated of waterproof material and having a removable hood in sac form equipped with a drawstring, whereby the hood is usable as a carrying bag. The jacket includes a removable liner which when removed functions as a long skirt to replace the slacks which are then stored in the carrying bag.

6 Claims, 12 Drawing Figures

10
11
14
15
16A
16B
17A
17B
18
19

CONVERTIBLE WOMEN'S ENSEMBLE

BACKGROUND OF INVENTION

This invention relates generally to convertible women's clothing, and more particularly to an ensemble constituted by a coat or jacket and a pair of slacks, the jacket having a removable liner which when removed functions as a skirt to replace the slacks which are then stored in the removable hood of the jacket which is capable also of functioning as a carrying bag.

At a time when travel was an infrequent event, the women travelling on a train or ocean liner would usually take along a commodious trunk filled with an assortment of wearing apparel suitable for different occasions. But in this age of mobility, a woman seeks to travel light and therefore takes with her a bare minimum of garments. Yet the modern woman is clothes-conscious and sensitive to the dictates of fashion.

Thus for active or outdoor wear, slacks are usually in order, while for more informal occasions a pants suit is appropriate. But it is in poor tast for a woman to enter a fashionable city restaurant wearing a pants suit, for then a long skirt is de rigueur. Should it rain, then the need arises for a head covering or hood and a waterproof coat or jacket. And on a sunny and cool day, a hoodless jacket providing warmth is more fitting. A modish woman who travels will normally anticipate her needs for changes of apparel. She may therefore have to carry a suitcase for an assortment of garments. But the current trend, particularly on short trips by air, is to avoid the inconvenience of suitcases which need to be checked in and checked out, and often gives rise to travel delays. The present preference is for a carry-on bag containing make-up, undergarments and other bare essentials. If, however, the woman traveller takes along, by way of clothing, only that which she has on, this may be inadequate, even on short trips.

SUMMARY OF INVENTION

In view of the foregoing, the main object of this invention is to provide a convertible women's ensemble capable of satisfying a range of apparel requirements, a single ensemble making it possible for the wearer to be appropriately dressed for active wear, for informal and formal occasions, and for rain or shine.

More particularly, an object of this invention is to provide a multi-mode convertible ensemble of the above type which is capable of serving selectively as a pants suit, as a skirt with or without a matching jacket, and as a hooded raincoat, the hood being removable to function as a carrying bag for those components of the ensemble not being worn in a given mode.

Also an object of this invention is to provide a multi-mode ensemble which may be mass-produced at low cost in a variety of styles, the ensemble being convertible into a desired mode quickly and without difficulty.

Briefly stated, these objects are attained in a convertible ensemble constituted by a long jacket which is preferably fabricated of waterproofed material and is provided with a removable hood in sac form equipped with a drawstring, whereby the hood is usable as a carrying bag.

The jacket includes a removable liner capable of functioning as a skirt, the waist portion of the liner/skirt having two zippered slits whose positions correspond to the arm holes of the jacket, so that when the liner is secured in place within the jacket, the slits are unzippered to admit the arms.

Also provided is a pair of slacks in a fabric and style which is coordinated with that of the jacket so that the slacks can be combined with the jacket to form a pants suit or can be worn separately.

When the need arises to wear a skirt, the slacks are stored in the carrying bag formed by the removed hood, and the liner is removed from the jacket and wrapped about the torso of the wearer, the zipper stringers on the margins of the liner which serve to secure the liner to the inside of the jacket then being joined together to complete the skirt.

OUTLINE OF DRAWINGS

For a better understanding of the invention as well as other objects and further features thereof, reference is made to the following detailed description to be read in conjunction with the accompanying drawings, wherein:

FIG. 6 is a front view of the jacket in its partially open condition;

Figure 8:
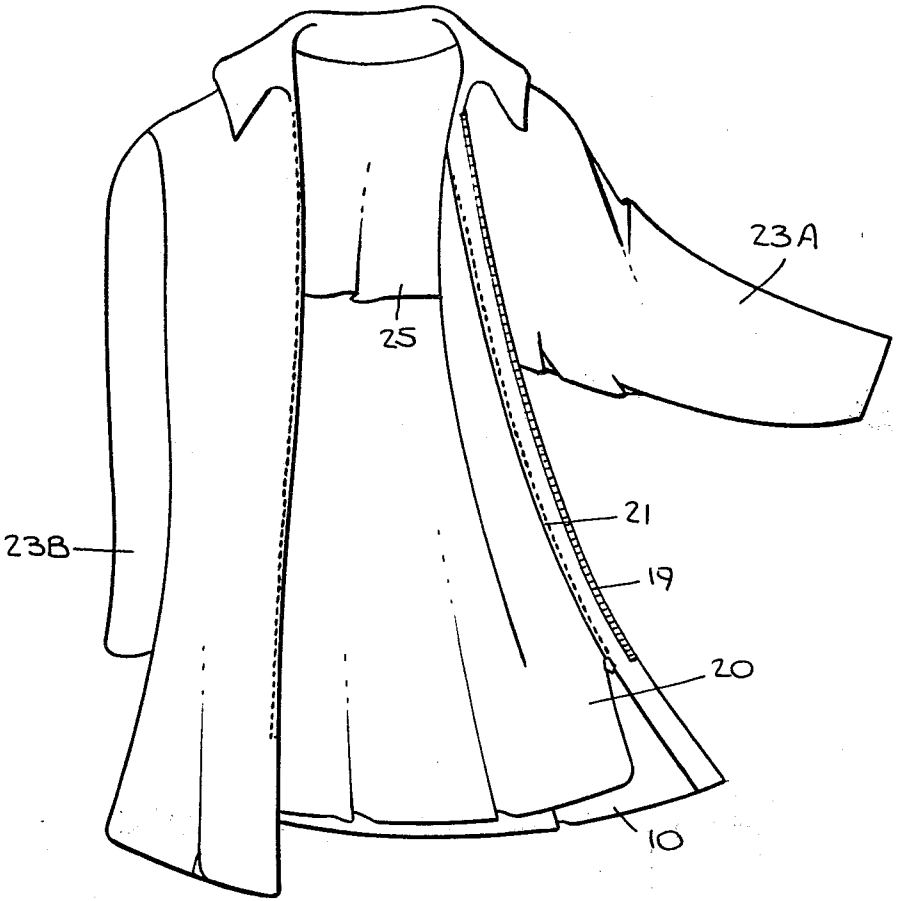
Figure 10:
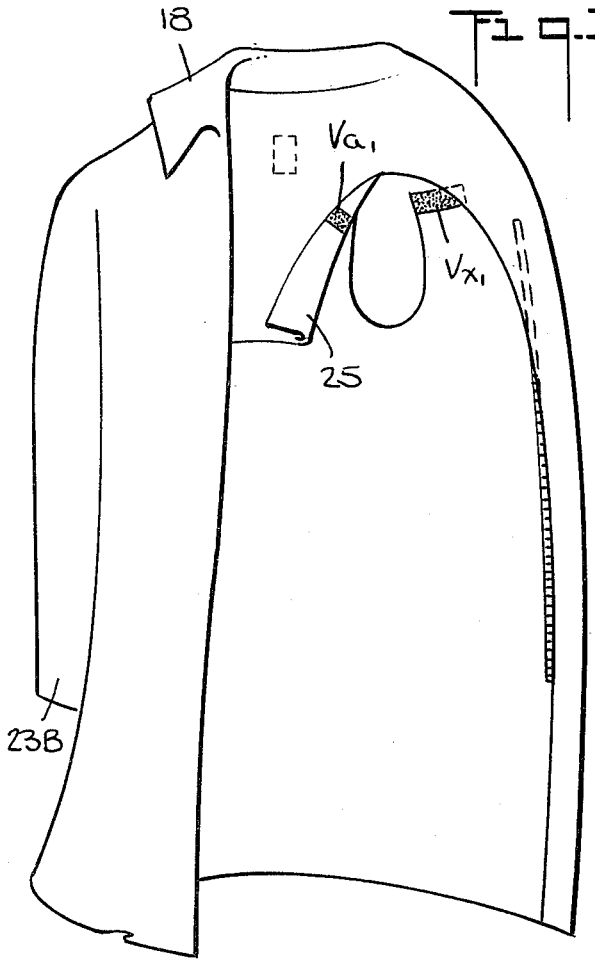
Figure 11:
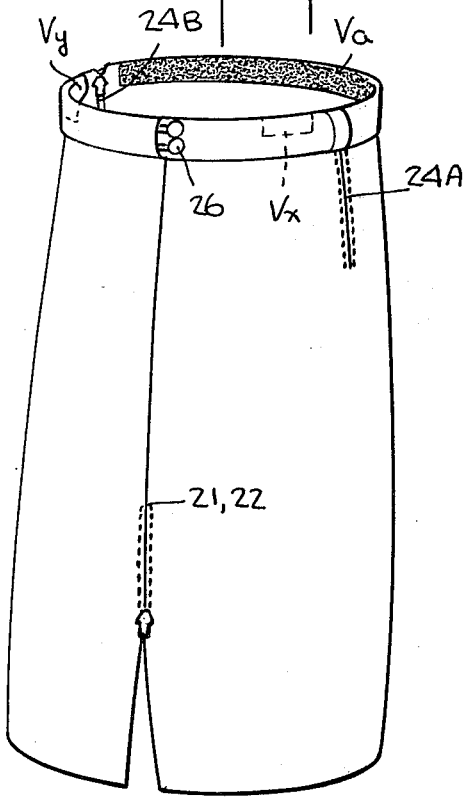
Figure 9:
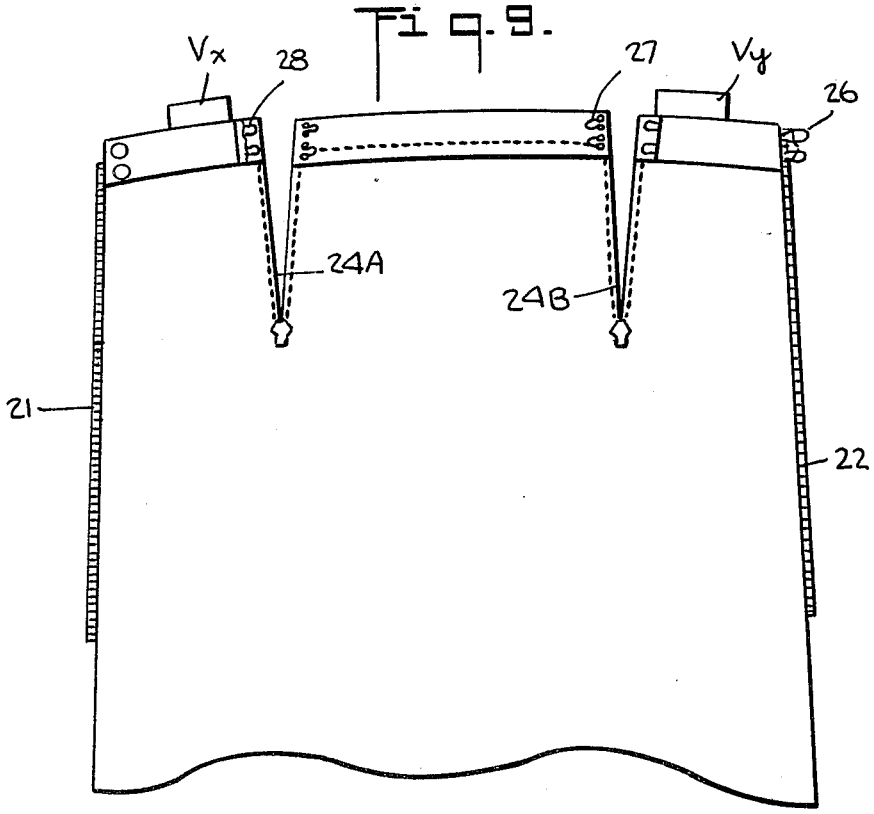

FIG. 8 separately shows the liner/skirt as seen from the inside;

FIG. 9 separately shows the liner/skirt as seen from the outside;

FIG. 10 shows the interior of the jacket in one arm hole area;

FIG. 11 shows the liner when functions as a skirt; and

Figure 12:
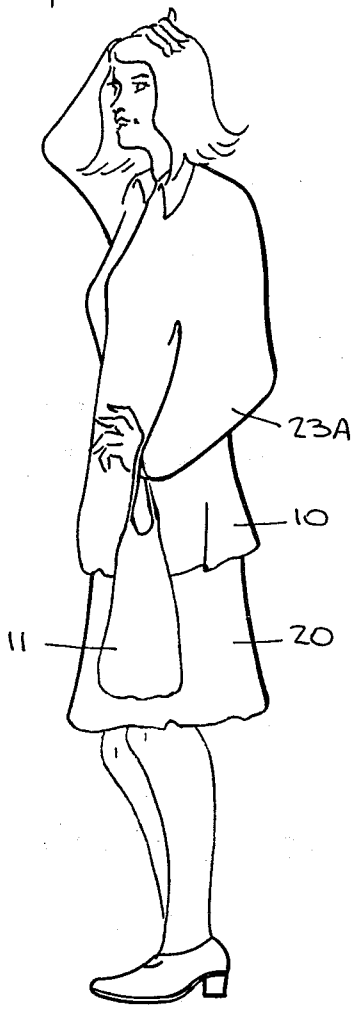

FIG. 12 is a view of the same woman wearing the convertible ensemble in the skirt and jacket mode.

DESCRIPTION OF INVENTION

Figure 1:
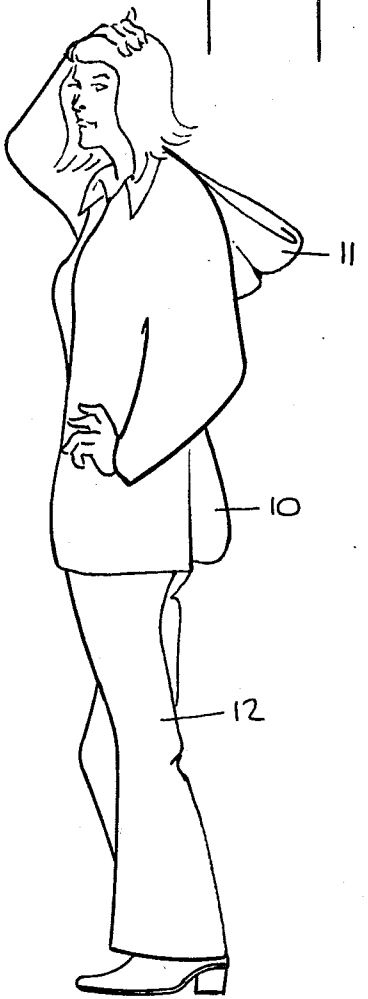
FIG. 1 is a view of a woman wearing a convertible ensemble in accordance with the invention, the ensemble being shown in its pants-suit mode.

Referring now to the drawing and more particularly to FIG. 1, there is shown a young lady wearing a pants suit derived from a convertible ensemble in accordance with the invention. The suit is constituted by a long jacket 10 having a removable hood 11, the jacket being combined with a pair of slacks 12.

The nature of the fabrics used in this suit are not evident in the Figure. But in practice, the materials of the slacks and the jacket are fully coordinated in the style sense. Thus the jacket and slacks may be fabricated of the same material, such as denim or velvet. Matching patterns or contrasting colors may be used, as determined by the designer.

The jacket and hood are preferably of waterproofed material so that the garment may, when necessary, function as a hooded rain coat. And since the jacket has a removable liner, the choice of liner material may be such as to impart sufficient warmth to make the jacket usable for cold weather wear. When the liner is recovered, the jacket is better suited for warmer weather.

Figures 2, 3, 4, 5:
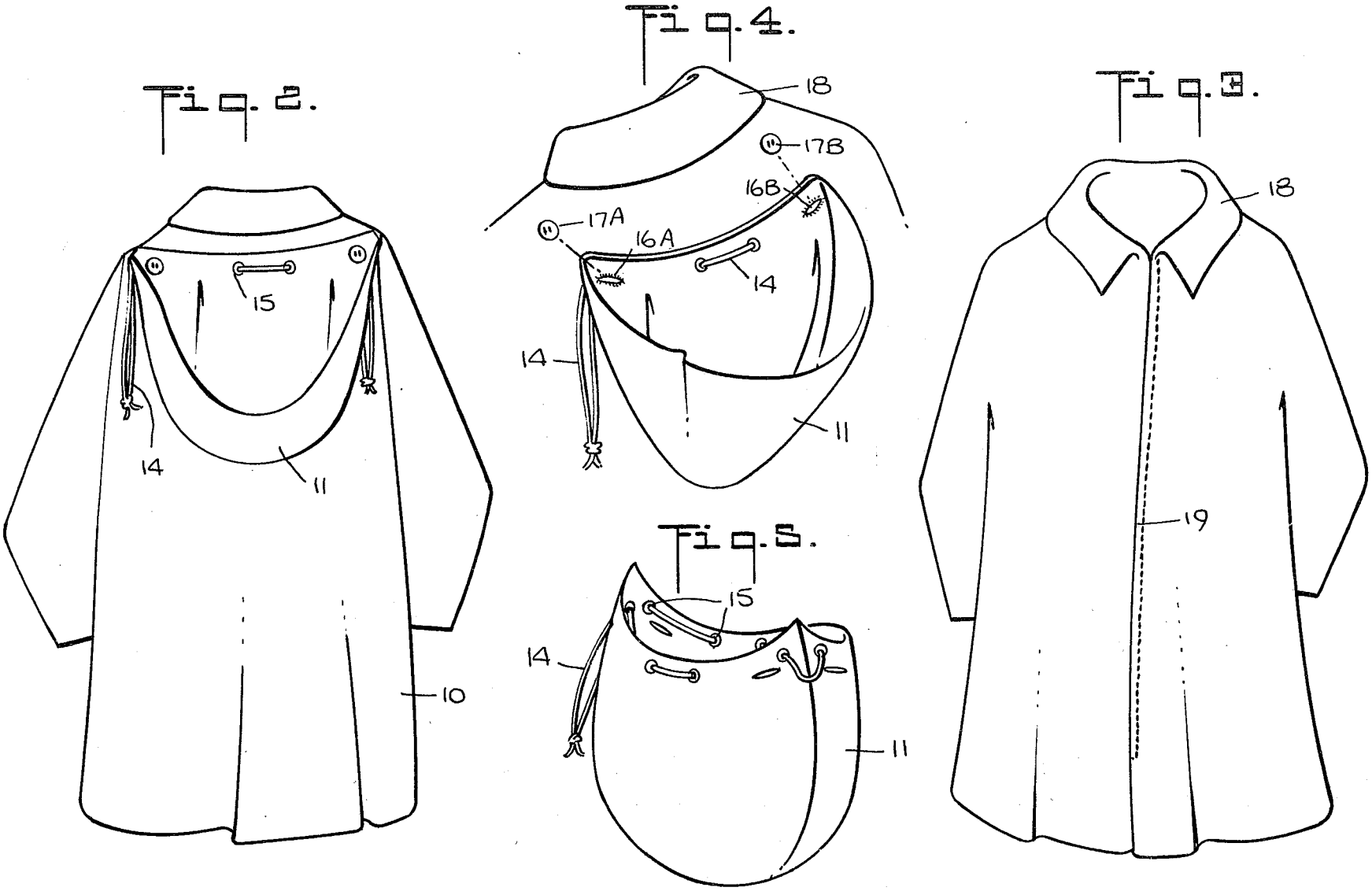
FIG. 2 is a rear view of the hooded jacket included in the ensemble.
FIG. 3 is a front view of the jacket.
FIG. 4 shows the hood being removed from the jacket.
FIG. 5 shows the hood converted into a carrying bag.

As shown in FIGS. 2 and 4, hood 11 has a sac-like formation and is provided with a drawstring 14 which is threaded through eyelets 15 attached at spaced positions along the margin. Also formed in the margin are two button holes 16A and 16B, making it possible to attach the hood to complementary buttons 17A and 17B sewed onto the jacket at the rear thereof just below the jacket collar 18. And, as illustrated in FIG. 3, the front panels of the jacket are provided with a closure in the form of a slide fastener or zipper 19. In practice, buttons or other fastening means rather than a zipper may be used for this purpose.

When, as shown in FIG. 5, hood 11 is removed from the jacket, it functions as a carrying bag which is closed by pulling drawstring 14, the drawstring then acting as a handle for the bag.

Figure 7:
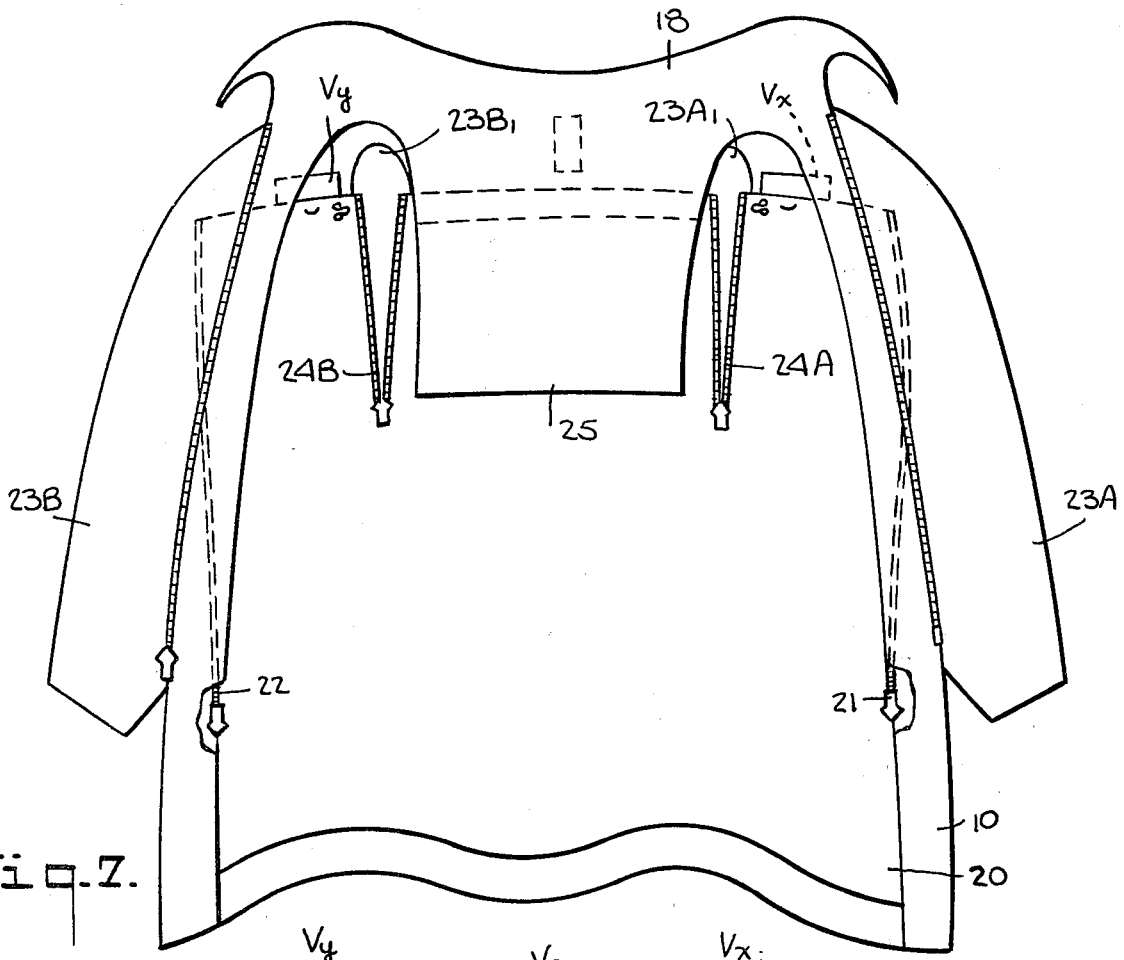
FIG. 7 shows the jacket fully open to expose the liner therein.
Figure 8:
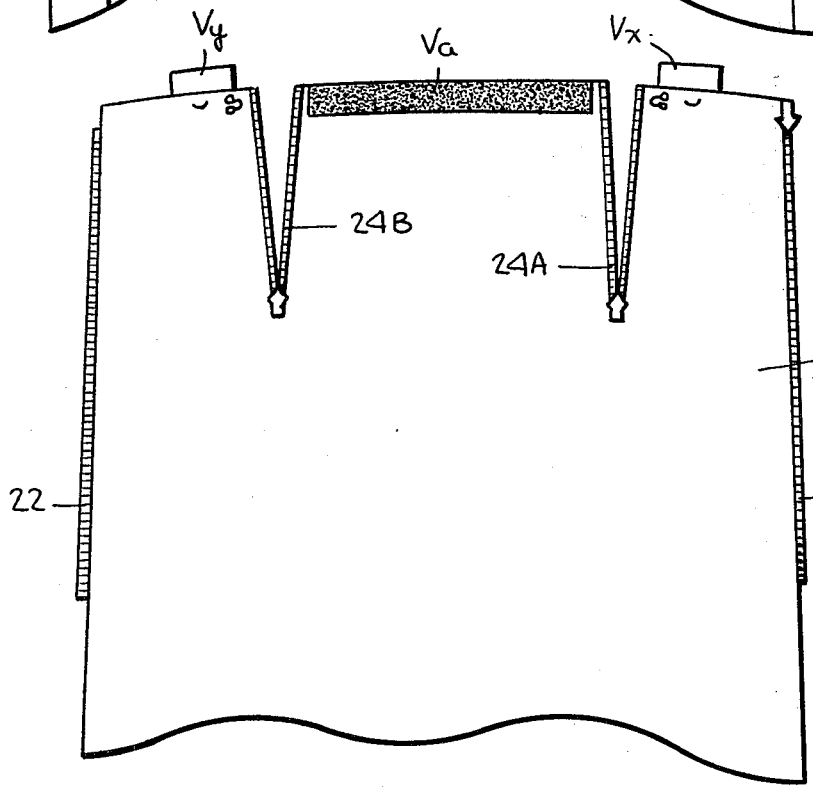

Referring now to FIGS. 6 and 7 showing the front of jacket 10 with its zipper 19 open, the interior thereof is lined with a removable liner 20, the long edges of which are secured to the jacket by zippers 21 and 22. As best seen in FIGS. 7 and 8, jacket 10 is provided with a pair of sleeves 23A and 23B, each having an armhole 23A and 23B. The upper end of liner 20, which functions as a waist band in the skirt-mode of this component, is provided with a pair of slits 24A and 24B in registration with the arm holes, the slits being closed and opened by slide fasteners. When in the liner mode, the slits are open to provide access to the arm holes.

Collar 18 of jacket 10 is provided with an inside flap extension 25 which overlies that section of the upper end of liner 20 which extends between slits 24A and 24B. To secure the upper end of liner 20 to the jacket, hook and loop fasteneners of the well-known Velcro type are used. Each fastener is constituted by a male or hook component composed of a uniform array of stiff nylon hooks, and a female or loop component constituted by a pile of tiny, soft nylon loops. When pressed together, the hooks become embedded in the loops and held thereby until the Velcro components are peeled apart.

Liner 10 is provided at its upper rear margin with a central Velcro tape component $V_a$ and a pair of Velcro flap components $V_x$ and $V_y$. The central component $V_a$ is joinable to a complementary component $V_{a1}$ secured to the inside surface of flap 25, whereas flaps $V_x$ and $V_y$ are joinable to complementary components secured to the jacket adjacent the arm holes, such as component $V_{x1}$ shown in FIG. 10.

The various zippers included in the ensemble, which may be of the metal teeth or of the helical plastic type, are formed of complementary stringers and a slide to intercouple and decouple the stringers. In the case of the components of zippers 21 and 22 on the edges of the liner which interconnect with complementary components on the jacket, components 21 and 22 complement each other. Thus in the skirt mode, as illustrated in FIG. 2, with slits 24A and 24B zippered closed, zipper components 21 and 22 are intercoupled to form a tube and thereby complete the skirt. The upper or waist portion of the liner above zipper components 21 and 22 is provided with a hook and button connector 26. Similar connectors 27 and 28 are provided at the upper ends of slits 24A and 24B.

We shall now review the various modes of dress provided by the convertible ensemble. In the pants-suit mode shown in FIG. 1, the wearer has on hooded jacket 10 and a pair of matching slacks 12, this combination being suitable for informal occasions. The wearer in the case of rain may cover her head with the hood, the jacket then serving as a protective rain coat. And because the jacket is lined, it provides warmth for cold weather wear.

For warmer weather, the hood may be removed and converted into a carrying bag for containing the removed liner, thereby making the jacket lighter. In the skirt mode, as shown in FIG. 12, the slacks are contained in the carry bag 11, and the removed liner 20 then functions as a long skirt, this being suitable for more formal occasions. In practice, the length of the jacket may be such as to provide a short coat, in which case there is more space for a longer liner and hence a longer skirt.

While there has been shown and described a preferred embodiment of a convertible women's ensemble in accordance with the invention, it will be appreciated that many changes and modifications may be made therein without, however, departing from the essential spirit thereof.

Thus instead of having a waterproof jacket material, the jacket and also the liner can be made of a reversible construction, with a waterproof layer of poplin or similar material on one side and an attractive fabric on the other, very much in the fashion of a reversible top coat. In this way, when encountering rain, the jacket can be reversed to expose the waterproof side, flap 25 then functioning as the rear yoke of the rainwear. And when the liner is removed to serve as a skirt, it is of reversible construction, it can, in case of rain, be reversed to expose the waterproof side.

We claim:

1. A convertible women's ensemble capable of satisfying a range of apparel requirements, said ensemble comprising:

A. a pair of slacks;

B. a jacket matching the slacks to define a pants suit, said jacket having arm holes and a removable hood which is convertible into a carrying bag for the slacks; and C. a removable liner whose long edges are attachable to the inside of said jacket in a liner mode and to each other in a skirt mode to define a skirt to replace the slacks said liner having zippered slits at positions corresponding to the arm holes of the jacket which slits are open in the liner mode and closed in the skirt mode.

2. An ensemble as set forth in claim 1, wherein said hood is provided with a drawstring which when drawn serves as a handle for the carrying bag.

3. An ensemble as set forth in claim 1, wherein said jacket and said hood are formed of waterproofed material.

4. An ensemble as set forth in claim 1, wherein the long edges of said liner and corresponding lines on said pocket are provided with cooperating zipper components, each of which has one component secured to the edge and the other to the jacket line, the components secured to the edges being joinable to each other to form a tubular skirt.

5. An ensemble as set forth in claim 1, wherein said jacket has a collar which includes an inner flap extension which overlies the upper end of the liner.

6. An ensemble as set forth in claim 5, wherein the upper end of the liner is secured to said flap by a hook and loop fastener.

* * * * *